US006071151A

United States Patent [19]

Igarashi

[11] Patent Number: 6,071,151

[45] Date of Patent: Jun. 6, 2000

[54] ELECTRICAL CONNECTOR HAVING A PLURALITY OF CONTACTS WITH INSULATION COVERING A PORTION OF CONTACT TO CREATE DIFFERENT CONTACT TIMINGS

[75] Inventor: Isao Igarashi, Akishima, Japan

[73] Assignee: Japan Aviation Electronics Industry, Limited, Tokyo, Japan

[21] Appl. No.: 09/099,970

[22] Filed: Jun. 19, 1998

[30] Foreign Application Priority Data

Jul. 7, 1997 [JP] Japan ..... 9-181556

[51] Int. Cl.[7] ..... H01R 24/00

[52] U.S. Cl. ..... 439/660; 439/924.1

[58] Field of Search ..... 439/607, 660, 439/924.1

[56] References Cited

U.S. PATENT DOCUMENTS

| | | | |
|---|---|---|---|
| 3,407,378 | 10/1968 | Siders et al. | 439/38 |
| 5,494,463 | 2/1996 | Nishio et al. | 439/181 |
| 5,641,308 | 6/1997 | Bixler et al. | 439/660 |

*Primary Examiner*—Steven L. Stephan
*Assistant Examiner*—Barry M. L. Standig
*Attorney, Agent, or Firm*—Laff Whitesel & Saret Ltd; J Warren Whitesel

[57] ABSTRACT

In a connector having a first and a second contact, the second contact has a portion covered with an insulating member. The insulating member causes contact timings of the first and the second contacts relative to a counterpart connector to be staggered from each other. The first and the second contacts are held by a housing which is attachable and detachable relative to the counterpart connector. It is preferable that the first and the second contacts have chamfered portions, respectively, and that one of the chamfered portions is covered with the foregoing insulating member.

7 Claims, 3 Drawing Sheets

ELECTRICAL CONNECTOR HAVING A PLURALITY OF CONTACTS WITH INSULATION COVERING A PORTION OF CONTACT TO CREATE DIFFERENT CONTACT TIMINGS

BACKGROUND OF THE INVENTION

The present invention relates to a connector having a plurality of contacts with different contact timings.

There has been a type of connector, for example, for a personal computer, which has a plurality of contacts whose contact timings relative to corresponding contacts of a counterpart connector are staggered, for example, between those contacts for some particular purpose and the others, for example, between contacts for confirming attachment relative to the counterpart contacts and contacts for signals.

For staggering the contact timings, there have been proposed connectors of various structures.

In one example, a plurality of contacts whose terminal portions have different lengths are arranged substantially at the same positions in attaching/detaching directions of the contacts relative to counterpart contacts. In this case, the terminal portions are offset in position among the contacts in the attaching/detaching directions. This causes the contact timings to be staggered from each other.

In another example, while terminal portions of contacts have the same lengths, the contacts themselves are offset in position in the attaching/detaching directions so as to stagger the contact timings.

However, as will be described in detail using a figure, either of the foregoing examples has problems of unstable contact timings relative to the counterpart contacts and size enlargement of the connector.

SUMMARY OF THE INVENTION

It is therefore an object of the present invention to provide an improved connector in which contact timings are stable in spite of having a plurality of contacts with different contact timings.

It is another object of the present invention to provide a connector of the type described, which is small in its size.

Other objects of the present invention will become clear as the description proceeds.

According to one aspect of the present invention, there is provided a connector comprising a housing which is attachable and detachable relative to a counterpart connector; a first and a second contact held by the housing and arranged to contact with the counterpart connector; and an insulating member covering a portion of one of the first and the second contacts. In the connector, the insulating member is provided for staggering contact timings of the first and the second contacts relative to the counterpart connector upon attaching of the housing relative to the counterpart connector.

According to another aspect of the present invention, there is provided a connector comprising a housing which is attachable and detachable relative to a counterpart connector, a first contact provided in the housing and arranged to contact with the counterpart connector, and a second contact provided in the housing and arranged to contact with the counterpart connector at a contact timing different from that of the first contact upon attaching of the housing relative to the counterpart connector. In the connector, one of the first and the second contacts has a portion covered with an insulating member. The contact timings of the first and the second contacts relative to the counterpart connector are staggered by the insulating member.

BRIEF DESCRIPTION OF THE DRAWING

FIG. 3 is a sectional view of the connector shown in FIG. 2, wherein the shell is capped on;

DESCRIPTION OF THE PREFERRED EMBODIMENT

Figure 1:
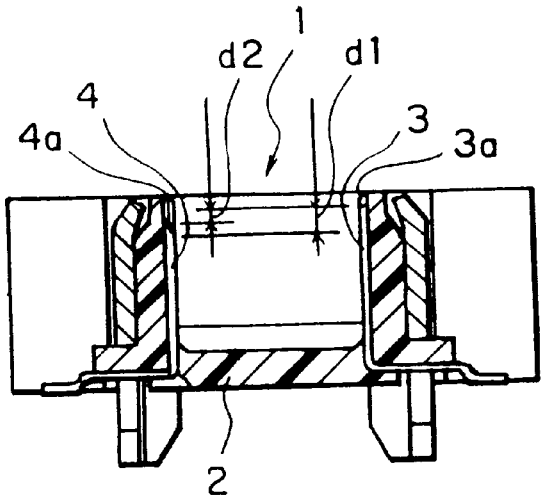
FIG. 1 PRIOR ART
FIG. 1 is a sectional view of a conventional prior art connector.

Referring to FIG. 1, description will be made at first as regards a conventional connector for facilitating understanding of the present invention.

The conventional connector is represented by numeral 1 and comprises an insulating housing 2, and first and second conductive contacts 3 and 4 press-fitted into the housing 2. The first contact 3 has a relatively long terminal portion, while the second contact 4 has a relatively short terminal portion. As a result, when seeing from the counterpart contacts, there is provided a step or offset at the terminal portions. By providing such an offset, contact timings of the first and the second contacts 3 and 4 relative to the counterpart contacts are staggered from each other.

For reducing an insertion force and a damage to the counterpart contacts, the terminal portions of the first and the second contacts 3 and 4 are provided with chamfered portions 3*a* and 4*a* at their ends confronting the counterpart contacts in attaching/detaching directions of the first and the second contacts 3 and 4 relative to the counterpart contacts. Since there is a certain distance between the tip and the root of each of the chamfered portions 3*a* and 4*a* in the attaching/detaching directions, a time lag is caused between a time point when the counterpart contact abuts the tip of the chamfered portion and a time point when it abuts the root thereof. This causes the contact timing relative to the counterpart contact to be unstable.

On the other hand, relative to a distance d1 between the roots of the chamfered portions 3*a* and 4*a* in the attaching/detaching directions, a distance d2 between the root of the chamfered portion 3*a* of the first contact 3 and the tip of the chamfered portion 4*a* of the second contact 4 in the attaching/detaching directions becomes smaller. For example, even if d1 is set to 0.5 mm, d2 becomes about 0.33 mm. Thus, for setting d2 to 0.5 mm, d1 should be greater than it so that the connector is enlarged in size.

Figure 2:
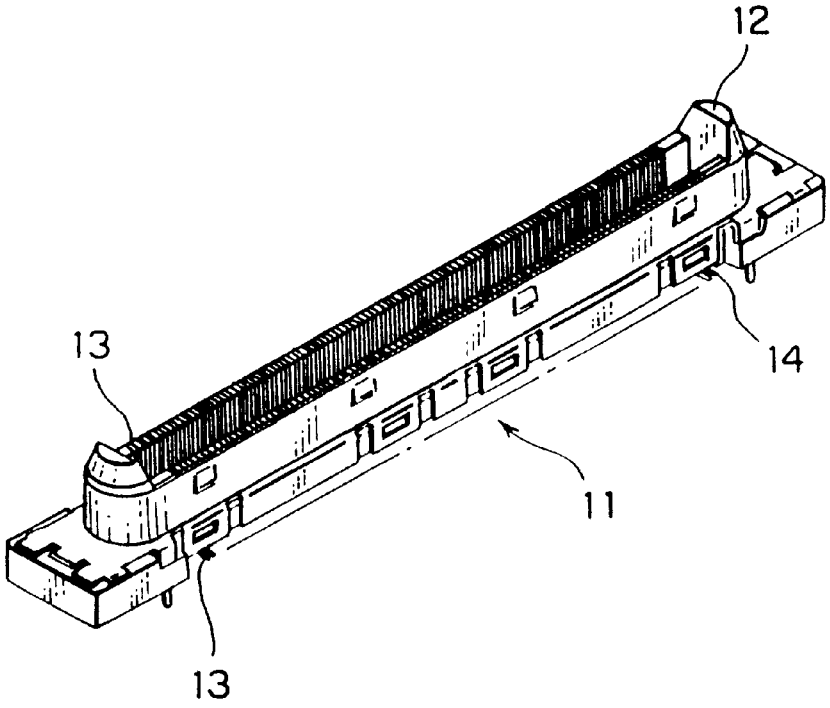
FIG. 2 is a perspective view of a connector according to a first preferred embodiment of the present invention.
Figure 3:
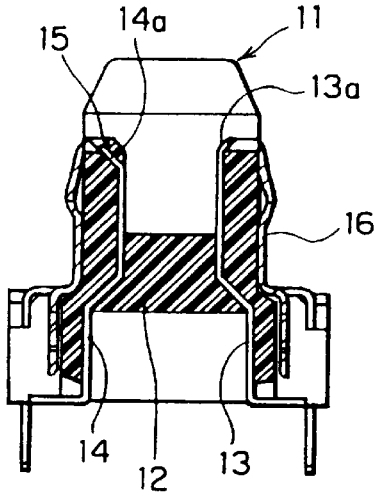

Referring to FIGS. 2 and 3, a connector will be described according to the first preferred embodiment of the present invention. The connector is represented by numeral 11 and comprises a housing 12, a first contact 13, a second contact 14 and a shell 16. The housing 12 is made of an insulating material, such as synthetic resin, and is attachable and detachable relative to a counterpart connector (not shown). The shell 16 is formed of a metal thin plate.

Each of the first and the second contacts 13 and 14 is made of a conductive contact material, such as a metal thin plate, and assembled integral with the housing 12 through molding. In the assembled state, lengths of terminal portions of the first and the second contacts 13 and 14, that is, the lengths in attaching/detaching directions thereof relative to corresponding contacts of the counterpart connector, are set to be essentially equal to each other.

Further, the first contact 13 is provided with a first chamfered portion 13*a* at its tip portion, while the second contact 14 is provided with a second chamfered portion 14*a* at its tip portion. In this embodiment, the second chamfered portion 14*a* is covered with an insulating member 15. The insulating member 15 is made of insulating synthetic resin which is the same as that forming the housing 12. The insulating member 15 is integrally molded upon molding-in of the first and the second contacts 13 and 14 with the housing 12.

Figure 4:
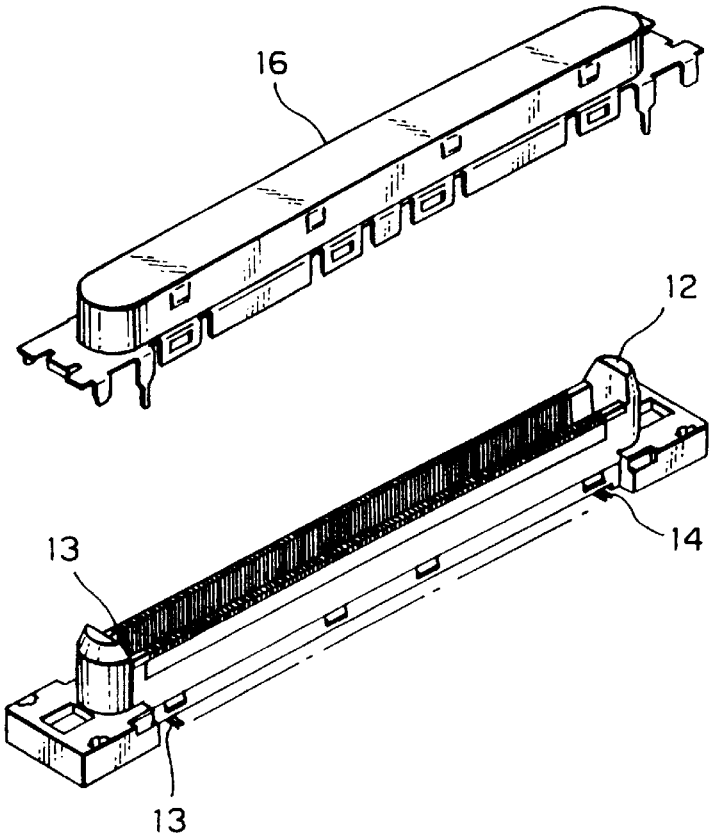
FIG. 4 is an exploded perspective view of the connector shown in FIG. 3.

Referring to FIG. 4, a procedure of producing the connector 11 will be explained. First, the first contact 13, the second contact 14 and the shell 16 are independently formed through press working or the like. During the press working, the first and the second contacts 13 and 14 are not formed with the chamfered portions 13*a* and 14*a*. These chamfered portions 13*a* and 14*a* are formed by a known machine tool before molding-in of the first and the second contacts 13 and 14 with the housing 12. In this event, bent portions at the first and the second chamfered portions 13*a* and 14*a* are offset in position from each other in the attaching/detaching directions. Specifically, as clearly seen from FIG. 3, the bent portion at the chamfered portion 13*a* of the first contact 13 is located closer to the counterpart contacts as compared with the bent portion at the chamfered portion 14*a* of the second contact 14. Then, the housing 12 is molded. In this event, the first and the second contacts 13 and 14 are molded-in with the housing 12 so that a resin molding is obtained. Then, by capping the resin molding with the shell 16, the connector 11 is completed.

According to the first preferred embodiment, upon attaching of the connector 11 relative to the counterpart connector, contact timings of the first contact 13 and the second contact 14 relative to the counterpart contacts are staggered from each other by means of the insulating member 15. Specifically, after the first contact 13 abuts the counterpart contact, the second contact 14 abuts the counterpart contact.

Figure 5:
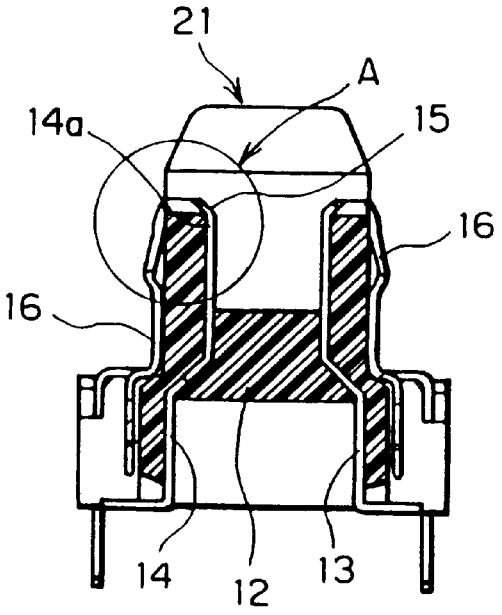
FIG. 5 is a sectional view of a connector according to a second preferred embodiment of the present invention.
Figure 6:
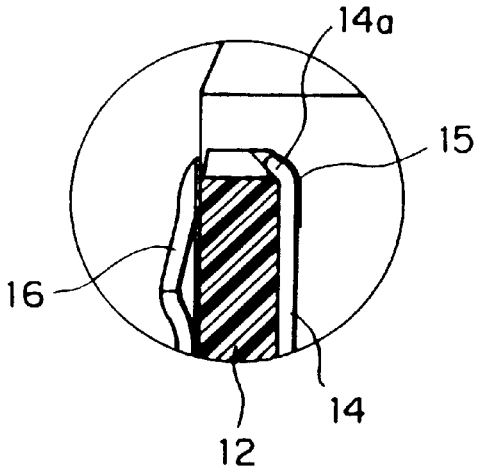
FIG. 6 is an enlarged view of a portion A in FIG. 5.

Referring to FIGS. 5 and 6, a connector will be described according to the second preferred embodiment of the present invention. The connector is represented by numeral 21 and comprises essentially the same components as those in FIGS. 2 to 4, which are designated by the same reference signs. In the connector 21, an insulating member 15 is formed through coating of an insulating material onto the second contact 14. The second contact 14 provided with the insulating member 15 can be easily produced by applying press working to a metal thin plate which is coated in advance with the insulating material at a given portion thereof. Naturally, it may also be arranged that after the press working, the second contact 14 is coated with the insulating material at a given portion.

What is claimed is:

1. A connector comprising:

first and second elongated spaced parallel contacts formed by conducting material strips of equal length, each of said strips having a tip end with a chamfered portion, said tip ends being angularly directed away from each other to form a flared entrance for receiving a counterpart connector having mating contacts which meet with said parallel strips, a molded plastic housing having an open space for receiving said counterpart connector with said first and second strips extending along opposite side walls of said open space, said strips being integrally molded into said plastic housing with surfaces of said counterpart connectors in said space, said integrally molded housing being free of internal cavities adjacent said strips, and insulating means at said tip end of one of said strips for preventing an immediate contact with a corresponding one of said mating contact, whereby said strips and mating contacts make connections at staggered time intervals, said insulating means forming a substantially smooth mechanical transition to said surface of said one of said strips whereby the mating contact on said counterpart connector slides into and out of said connection substantially without any discontinuity of said sliding motion, thereby preventing contact bounce and wear.

2. The connector of claim 1 wherein the angular tip of end said one strip is buried in said plastic during molding thereby forming said insulating means and making said smooth transitions to said surface of said one strip.

3. The connector of claim 1 wherein said insulating means is an insulating coating applied to said angular tip end of said one strip.

4. The connector of claim 3 wherein said insulating coating is applied to said tip end prior to said one strip being molded into said housing.

5. A connector as claimed in claim 1, wherein said insulating member is made of resin.

6. A connector as claimed in claim 5, wherein said resin covers the portion of said one of said first and said second contacts through molding.

7. A connector as claimed in claim 5, wherein said resin covers the portion of said one of said first and said second contacts through coating.

* * * * *